United States Patent [19]

Küsel et al.

[11] Patent Number: 4,947,756

[45] Date of Patent: Aug. 14, 1990

[54] LAYING RAILWAY TRACK

[75] Inventors: Peter G. Küsel, P.O. Box 73019, Lynnwood Ridge 0040, 0040; Joachim Rose, Pretoria, both of South Africa

[73] Assignee: Peter G. Küsel, Pretoria, South Africa

[21] Appl. No.: 395,258

[22] Filed: Aug. 17, 1989

[30] Foreign Application Priority Data

Aug. 18, 1988 [ZA] South Africa ..... 88/6117

[51] Int. Cl.[5] ..... E01B 1/00

[52] U.S. Cl. ..... 104/2; 238/2; 238/6

[58] Field of Search ..... 238/2, 5, 7, 24, 25, 238/29, 30, 84, 109, 114, 115, 116, 117, 129, 265, 310, 6; 104/2

[56] References Cited

U.S. PATENT DOCUMENTS

| | | | |
|---|---|---|---|
| 259,726 | 6/1882 | Smith | 238/116 |
| 4,174,066 | 11/1979 | Dugasz | 238/7 |
| 4,679,731 | 7/1987 | Klugar et al. | 238/2 |

FOREIGN PATENT DOCUMENTS

| | | | |
|---|---|---|---|
| 1534039 | 1/1969 | Fed. Rep. of Germany | 238/2 |

*Primary Examiner*—Andres Kashnikow
*Assistant Examiner*—Mark T. Le
*Attorney, Agent, or Firm*—Richard J. Myers

[57] ABSTRACT

Railway track is laid by supporting the rails in spacers above a pair of parallel flexible tubes, which are then filled with aggregate under pressure to contact the feet of the rails and to curl around the feet so that when set the rail is continuously supported and no sleepers or ballast are required.

2 Claims, 4 Drawing Sheets

LAYING RAILWAY TRACK

FIELD OF THE INVENTION

This invention relates to the laying of railway track.

BACKGROUND OF THE INVENTION

Conventional railway track involves the laying of sleepers at predetermined distances apart depending on the loading of the line, and the laying of ballast. Both the sleepers and the ballast have to be replaced from time to time and one of the objects of the present invention is to avoid this labour and cost.

Another object of the invention is to reduce the cost of supporting the track by eliminating the necessity for transverse sleepers.

A further object of the invention is to reduce the size and mass of rail required by providing continuous support under the rails, thereby also reducing cost.

A yet further object of the invention is to reduce the time and therefore the cost of laying track and to reduce the actual material cost substantially.

A still further object of the invention is to substantially simplify the construction of continuous or partly continuous foundation beams required for heavy axle equipment application such as the wheeled foundation structures of crane, stackers, reclaimers and shiploaders in the ore transporting applications.

A further object of the invention is to enable continuous or partly continuous support to be constructed with greater safety and ease over bad soil conditions such as marshy ground.

THE INVENTION

According to the invention a method of laying railway track includes the steps of supporting rails at a predetermined gauge and horizontal and vertical alignment, locating a former or formers longitudinally under the rails adapted to receive and contain aggregate to the level of the feet of the rails, and filling the former or formers with aggregate.

The former or formers are preferably flexible tubular elements as described below but it will be appreciated that suitable shuttering or the like may also be employed.

In one form of the invention the tubular elements are located in parallel trenches and transverse spacer elements extend over the trenches to support the rails above the trenches, and then filling the tubes with aggregate.

One continuous trench may be formed with the parallel tubular elements located therein.

The tubes will take up the shape of the trenches so that the latter do not have to be accurately dug. If parallel trenches are not provided—for example if a continuous trench is formed or the elements are merely located on the ground, the tubular elements may be constrained during filling with aggregate by means of suitable shuttering.

The upper surface of the tubular elements will contact the feet of the rails and will tend to creep around the feet to provide a continuous bed for the rails and ensure that the exact gauge is maintained.

The tubular elements may be of inexpensive polymeric material such as polyethylene and may be in the form of long extruded formations of predetermined diameter according to the dimensions of the trenches, and/or the height required for adequate contact with the feet of the rails and to provide sufficient bearing in the ground.

The spacer elements may comprise a tie between opposed clip formations adapted to receive the width of the feet of the rails and preferably to curl over the feet. These clip formations may also include rail clip holders adapted to be embedded in the aggregate. The rail clips may be prelocated in position prior to the aggregate pumping step.

The shuttering referred to above may include opposing plates joined by arched members, which in position bridge the rails and the plates, which slope outwardly for easy removal, and establish a beam-like form for the filled tubular elements.

The spacer elements may include a bar terminating at each end in a vertical square or rectangular or other shaped formation for passage therethrough of the tubular element and confining the filled tubular element at those locations of the spacers.

Intermediate clips may be used between successive spacers and these clips may be grouted into the aggregate.

EMBODIMENTS OF THE INVENTION

Embodiments of the invention are described below with reference to the accompanying drawings, in which.

Figure 1:
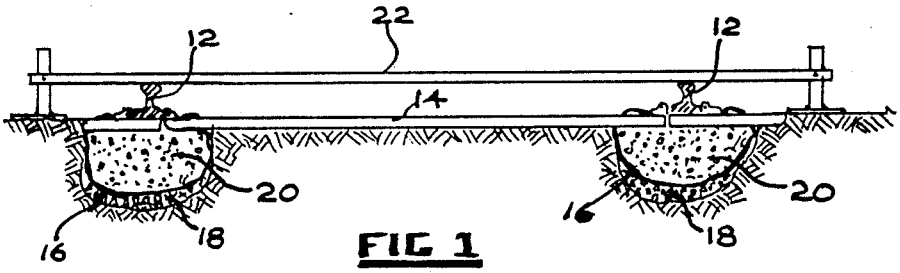
FIG. 1 is a cross sectional view of one form of the invention.
Figure 2:
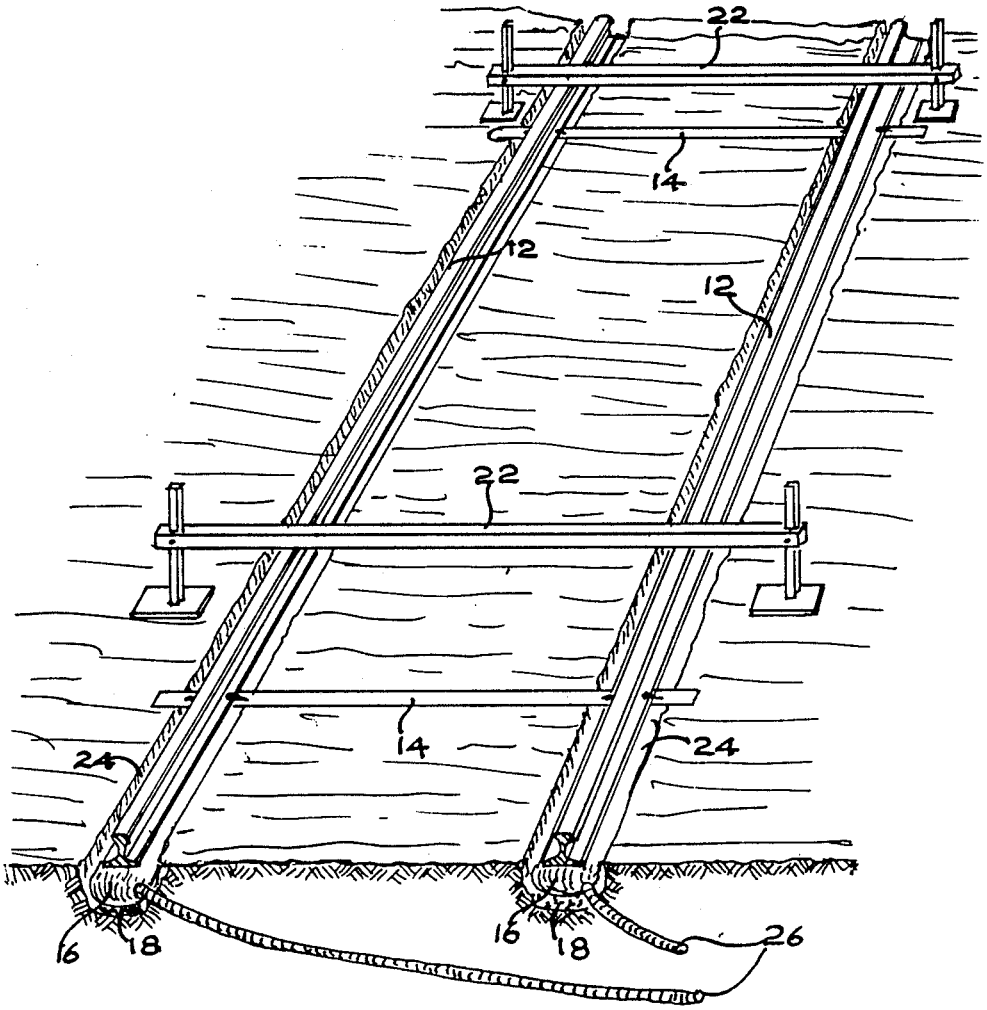
FIG. 2 is a shortened perspective view of the arrangement of FIG. 1.

Referring first to FIGS. 1 and 2, rails 12 are located either side of a spacer 14. This spacer extends over trenches 18 below the rails and elongate tubular elements 16 are placed in the trenches 18 and are then filled through pipes 26 with an aggregate under pressure.

The rails are held down by cross members 22 during the filling procedure; and this filling procedure results in a raised portion 24 being formed on both sides of the feet of the rails so that the rails are firmly held at the required gauge.

Figure 3:
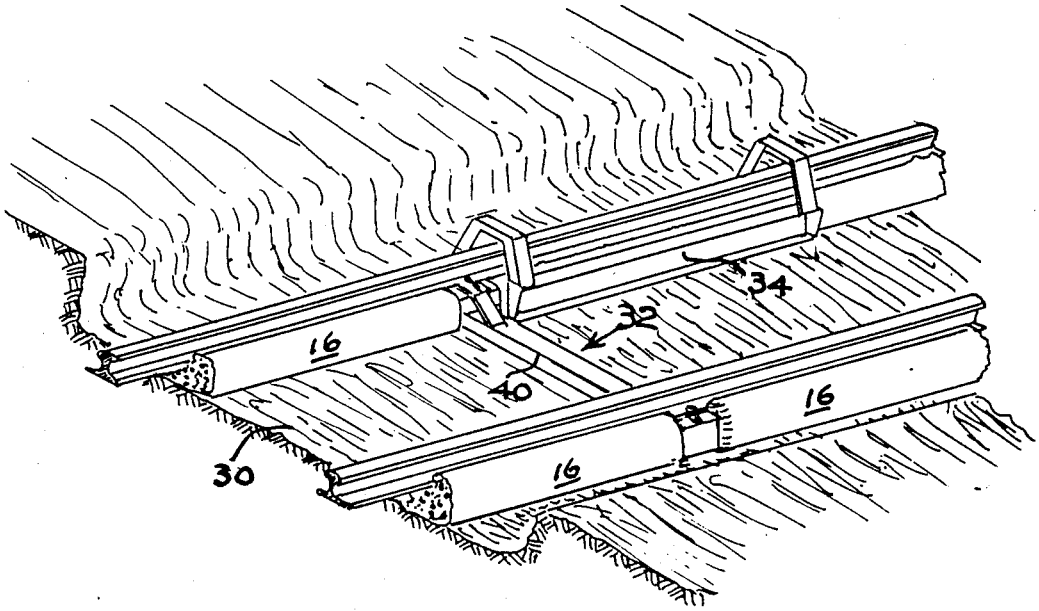
FIG. 3 is a similar view to FIG. 2 and of another form of the invention.

In FIG. 3 a single trench 30 is dug and the spacers 32 are placed at the desired distances apart along the length of the desired track and at the correct height—adjustments in height being easily accomplished. A series of shutters (only one of which is shown and indicated as reference 34) are placed in position for the length of the tubular elements 16 being filled. FIG. 3 shows the final result with all the shutters save that indicated by reference 34 having been removed. Thus, a beam-like continuous support for the rails is obtained.

Figure 4:
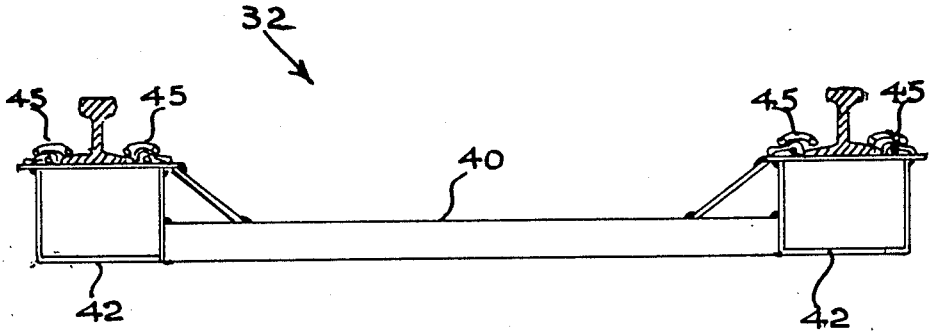
FIG. 4 is a side view of a spacer element.
Figure 5:
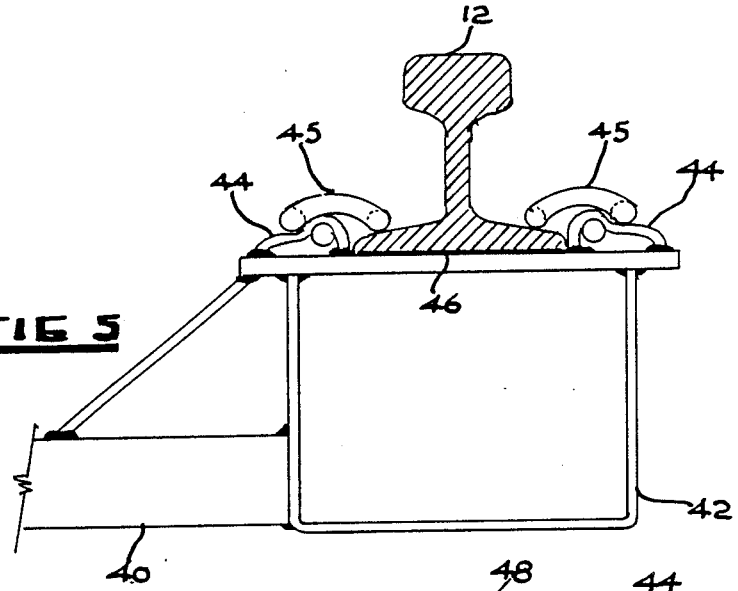
FIG. 5 is a detail of FIG. 4.

The spacers are shown in more detail in FIGS. 4 and 5. Spacer bars 40 terminate on either end with square section formation 42 through which the tubular elements pass, as described above. Shoulders 44 (seen in greater detail in FIG. 5) are welded to the top of the square formations 42 to receive the clips 45 which secure the feet of the rails which rest on a pad 46. These clips may be of any conventional type, for example a Pandrol clip.

Figure 6:
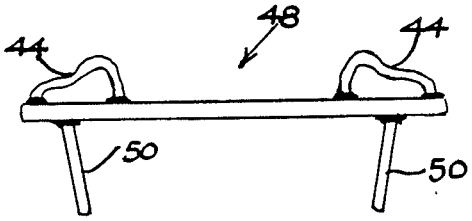
FIG. 6 is a side view of an intermediate guage tie bracket.

Intermediate gauge tie brackets 48 which are grouted into the aggregate are shown clearly in FIG. 6 and have angled prongs 50 and shoulders 44 welded as shown. These shoulders 44 are designed to receive the conventional clips.

Figure 7:
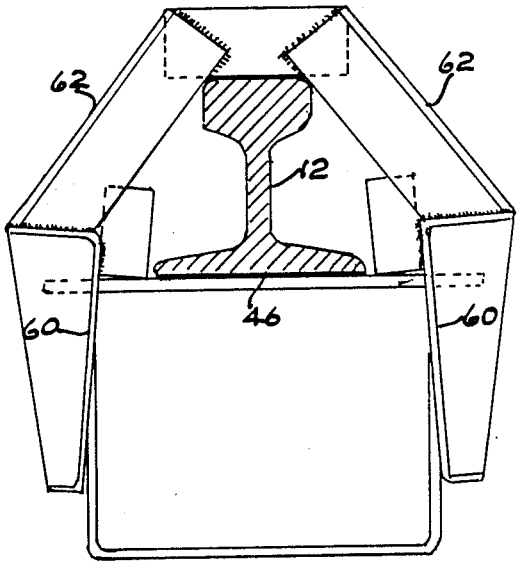
FIG. 7 is an end view of a shutter arrangement for the invention.

In FIG. 7 a shutter is shown in end view. The shutter comprises plates 60 which flank the tubular element 16 (not shown in FIG. 7) filled with aggregate. The plates slope outwardly as shown so that they are easily removed after the filling procedure. The plates are joined by arched formations 62 which bridge the rails 12. These shutters are re-usable, easily locatable and easily removable and are inexpensive to manufacture.

Figure 8:
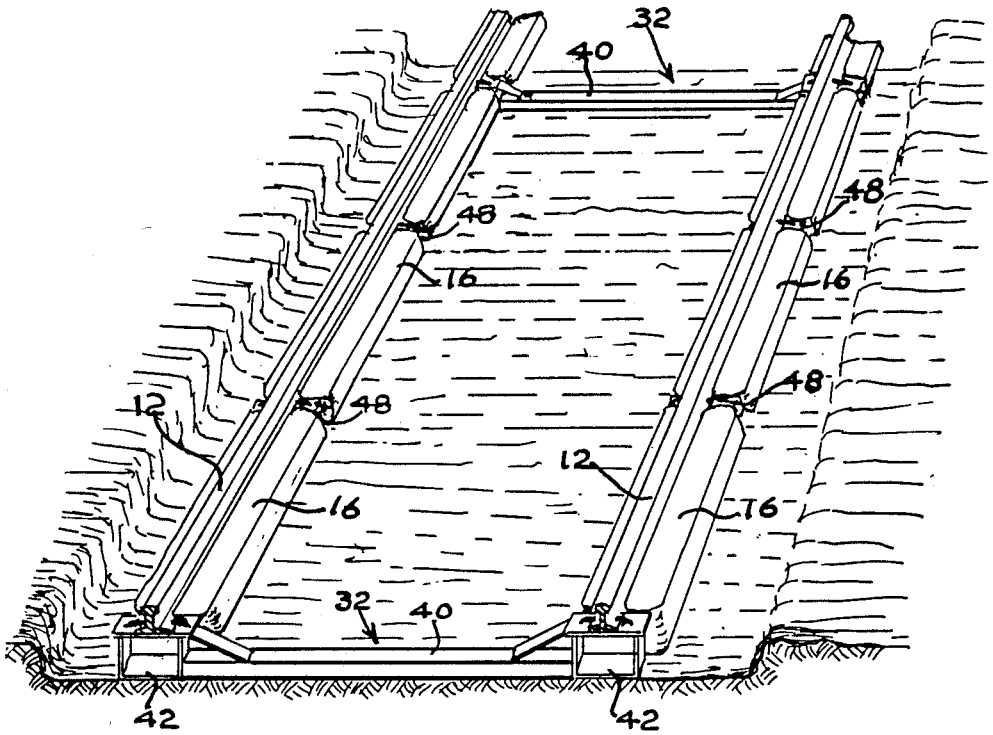
FIG. 8 is a perspective view similar to that of FIG. 3 illustrating the relationship between spacers and the intermediate tie brackets.

In FIG. 8 the relationship between spacer elements 32 and intermediate tie brackets 48 is illustrated showing two sets of tie brackets located between spacer elements.

I claim:

1. A method of laying railway track including the steps of supporting rails at a predetermined gauge and horizontal and vertical alignment, locating flexible tubular elements under the rails, constraining the tubular elements with shuttering and filling the tubular elements with aggregate, after the tubular elements are placed in position under the rails, until the aggregate creeps around the feet of the rails.

2. The method according to claim 1, and in which trenches are constructed below the rails, the trenches serving as the shuttering.

* * * * *